7/28/81 XR 4,280,240

United States Patent [19]

Neuscheler

[11] 4,280,240

[45] Jul. 28, 1981

[54] HANDLE FOR WATER SKI TOWLINE WITH ENGAGEMENT AND DISENGAGEMENT MEANS FOR WATER SKI SAFETY BELT

[76] Inventor: Wilhelm Neuscheler, Spitzholzstr. 113, 7032 Sindelfingen, Fed. Rep. of Germany

[21] Appl. No.: 72,286

[22] Filed: Sep. 4, 1979

Related U.S. Application Data

[63] Continuation-in-part of Ser. No. 5,232, Jan. 22, 1979.

[30] Foreign Application Priority Data

Sep. 2, 1978 [DE] Fed. Rep. of Germany ..... 2838393

[51] Int. Cl.[3] ..... A63C 5/00; A63C 9/00; A63C 11/00; A63C 15/00

[52] U.S. Cl. ..... 9/310 A; 114/253

[58] Field of Search ..... 182/3.9; 115/6.1; 114/253; 9/310 A, 310 AA, 310 R; 244/151 R, 151 A, 151 B, DIG. 1; 24/201 R, 132 R, 133

[56] References Cited

U.S. PATENT DOCUMENTS

| | | | |
|---|---|---|---|
| 2,754,073 | 7/1956 | Holm | 24/201 R |
| 2,940,148 | 6/1960 | Gentile | 24/201 R |
| 3,071,100 | 1/1963 | Nicholson | 115/6.1 |
| 3,324,818 | 6/1967 | Dunlap | 115/6.1 |
| 3,494,319 | 2/1970 | Dunlap | 115/6.1 |
| 4,140,205 | 2/1979 | Matson | 115/6.1 |

*Primary Examiner*—Trygve M. Blix
*Assistant Examiner*—D. W. Keen
*Attorney, Agent, or Firm*—Craig and Antonelli

[57] ABSTRACT

A handle for a water ski towline comprises two shell-like halves with engagement and disengagement mechanism for detachably securing a pull strap that is secured to a connecting strap of a safety belt for water skiers secures the pull strap by means of an engagement finger that is engageable in a cut-out of the pull strap, the engagement finger being spring biased into a position engaged within the cut-out. According to a feature of the preferred embodiment, the entire engagement and disengagement mechanism is accommodatable within the shell-like halves, and the handle is inclined forwardly from its center at an angle of approximately 8° to 12° with respect to a line normal to a center line directed in the towing direction.

8 Claims, 7 Drawing Figures

I
23
12
24
15
16'
II
16
15
28/29
III
X
31
14
22
21'
20
21
17
IV
26
18
19
25
16'
16
28
29
22
27
17
18
19

HANDLE FOR WATER SKI TOWLINE WITH ENGAGEMENT AND DISENGAGEMENT MEANS FOR WATER SKI SAFETY BELT

BACKGROUND AND SUMMARY OF THE INVENTION

This application is a continuation-in-part of U.S. Application, Ser. No. 5,232, filed Jan. 22, 1979.

The present invention relates to a handle for a water ski towline with a mechanism for engagement and disengagement of a safety belt for water skiers, this belt being applied approximately below chest level, of the type described in my above-noted application.

As pointed out in the above-referenced application, it is known that a water skier during starting from deep water must expend great strength which primarily and vigorously stresses the arm and finger muscles. To make water skiing possible even for those persons who do not possess the required strength in their arms and hands, especially elderly persons or beginners, my earlier invention and the present invention have been provided so as to enable starting from the water to be achieved with it being only necessary to expend a certain degree of strength in the arms for the purpose of attaining one's balance.

Additionally, as with my earlier embodiments, it is possible to actuate the mechanism for engagement and disengagement of the towline only with one hand, so that the other hand is entirely free to attain one's balance. After starting, insofar as desirable, the disengagement mechanism can be operated by letting go the respective hand from the handle activating lever and stretching the other arm, which was slightly bent. At this point in time, the connection between the handle and the safety belt of the water skier is automatically severed, and water skiing can proceed as usual. The connection is also severed in case of a possible fall, and re-engagement during water skiing is readily possible.

By the action of a spring, the fitting at the safety belt for the water skier is retained after being pressed into the engagement means until the water skier grasps with his free hand the portion of the handle with the coupling lever. Now the full force can again be transmitted directly to the body.

In case of waves, the provision is made that a short portion of the water ski towline consists of a rubber cable having the purpose of acting as a shock absorber during wave action, which has an especially strong effect when the safety belt is engaged. Furthermore, a very impressive effect can be attained while slalom skiing, in that higher speeds are attained after turning.

Attempts have been made, in the prior art, to improve the hold on the handle by having a contact element, to which a divided water ski towline is attached and is guided at the handle, press against the fingers and hold same, so to speak, in clamping engagement (see DOS [German Unexamined Laid-Open Application]2,202,841.) However, this invention provides no advantages as compared to the conventional, simple handles because the water skier's hands and arms must still absorb the necessary forces. In case of a false start there is even the danger that the water skier cannot free his hands from the handle and is pulled underwater, which can have bad consequences. In case of a fall during top speed, the water skier may even have one or the other of his arms dislocated.

While according to my earlier patent application, a handle has been disclosed which avoids the above-noted disadvantages of the prior art and reduces the strength required to start water skiing, certain disadvantages still exist due to such features as bare steel edges and due to the large weight of the entire handle present in the embodiment shown therein.

These aforementioned disadvantages are avoided by the present invention, in that the entire force entering by way of the water ski towline is transmitted, via the handle, by means of a connecting strap through the safety belt to the body of the water skier. The engagement and disengagement mechanism in the handle is dimensioned so that, for example in case of a false start or a fall during skiing, after the handle has been released, the connection with the safety belt of the water skier is severed, and thus nothing can happen.

As with my earlier arrangement, easy disengagement of the pull strap at the connecting strap to the safety belt of the water skier is attained due to the fact that the finger of the disengagement lever has an unobstructing inclined surface which, in the present invention, slides off the finger of the disengagement and engagement lever after the respective hand has been released and the other, slightly bent arm has been straightened, thus completing the separation between the water skier and the towline.

Furthermore, the present invention utilizes a compression spring that enables engagement during skiing to be more readily effected. With one arm the skier must pull at the handle while inserting a connecting strap with the other arm or hand into the opening of the engagement mechanism, and thereafter, the handle with the engagement and disengagement lever can be grasped with the released hand, and both arms can be stretched until the full pull of the towline is effective on the body. The engagement prior to starting to water ski is entirely without problems.

These and other objects, features and advantages of the present invention will become more apparant from the following description when taken in connection with the accompanying drawings, which show, for purposes of illustration only, a single embodiment in accordance with the present invention.

DETAILED DESCRIPTION OF THE PREFERRED EMBODIMENT

Figure 1:
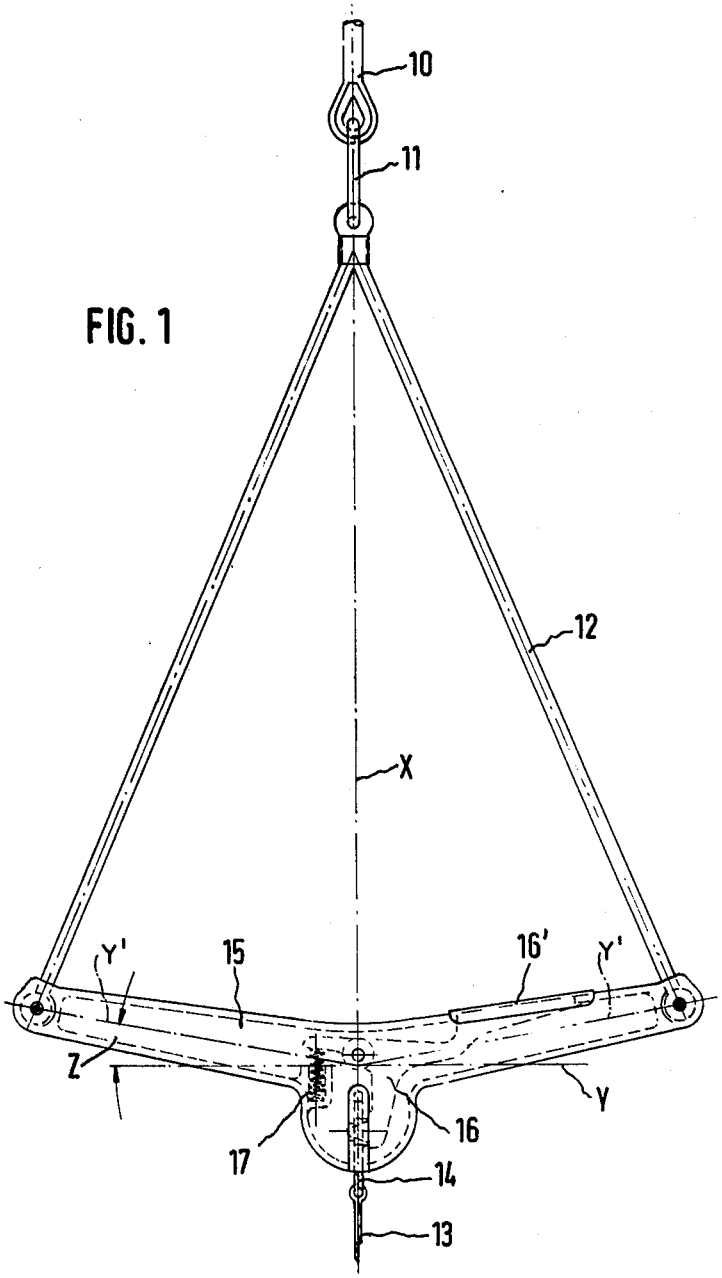
FIG. 1 shows a perspective view of a handle arrangement for a water ski towline with an engagement and disengagement device for the connecting strap to the safety belt of the water skier according to a preferred embodiment.

FIG. 1 shows an arrangement according to one embodiment of a handle for a water ski towline with an engagement and disengagement mechanism for a water ski safety belt. The towline is designated by the reference numeral 10, a spring safety hook by 11, a bifurcated cable by 12, a connecting strap for a water ski safety belt by 13, a pull strap of the connecting step by 14, the assembled handle by 15, an engagement and disengagement lever by 16, a gripping shell for holding the engagement and disengagement lever by 16', and a compression spring by 17.

The centerline of the handle assembly shown in FIG. 1 is shown as X and both the towline 10 and the attachment point for the connecting strap 13 lie thereon. Additionally, it can also be seen that the handle portions which extend to the left and right of the centerline X have their centerline Y' inclined forwardly with respect to the towing direction so as to form an angle Z between the centerlines Y' and a line Y that passes through the intersection of the lines Y' and X. This forward angular inclination of the handle portions is an important feature of the invention since it has been found from practical tests that, when the angle Z is between 8 to 12 degrees that a water skier's wrists will be so angled as to prevent premature tiring.

Figures 2, 3, 4, 5:
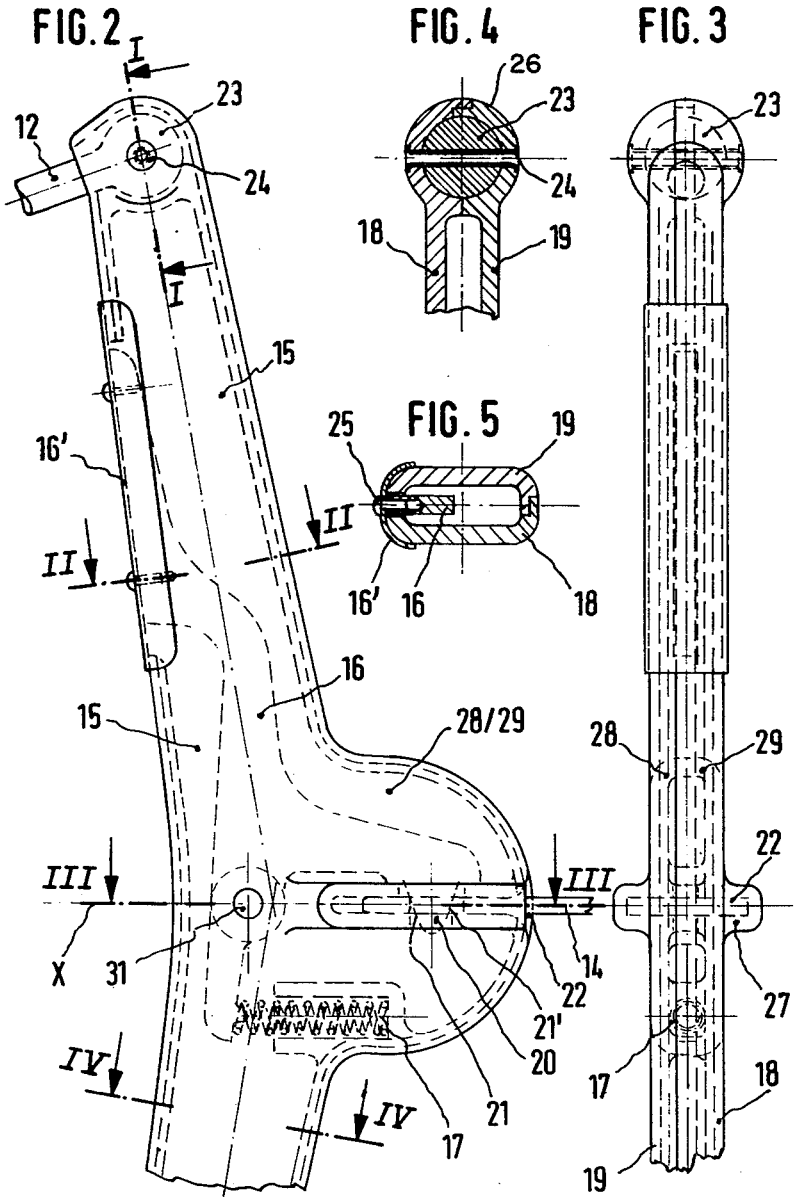
FIG. 2 is a partial enlarged view of more than half the handle in a top view.
FIG. 3 is a lateral view of FIG. 2.
FIG. 4 is a section along line I—I in FIG. 2.
FIG. 5 is a section along line II—II in FIG. 2.

Turning now to FIG. 2, the engagement and disengagement mechanism can be seen on an enlarged scale in a top view. The engagement and disengagement mechanism is formed by an engagement and disengagement lever 16 which is pivotally mounted on the centerline X on a bearing 31. The gripping shell 16' is connected to one end of the lever 16, while a compression spring 17 is positioned so as to apply a biasing force against the other end of the lever 16 so as to cause a finger 21 to be swung into a pull strap engaging position. As viewed from above, the finger 20 has an outwardly tapering configuration whereby a forward facing surface 21 slopes away from the towing direction while a rearward facing surface 21' slopes toward the towing direction. The function of these sloping surfaces 21, 21', will be noted in greater detail below.

FIGS. 2 and 3, clearly show how the handle has been designed so as to prevent the existence of any potentially dangerous metallic edges or projections by the enclosing of the engagement and disengagement lever entirely within the handle with a receptacle portion 27 being provided for the seat of the pull strap 14 within an opening 22 thereof.

Additionally, it can be seen that the handle 15 is formed by upper and lower shell-like halves 18, 19, respectively which define a central hollow space within which the engagement and disengagement lever 16 is housed. The ends 26 of the shell-like halves are semicircularly shaped so as to enable the spherically shaped ends 23 of the cable 12 to be securely retained therein, such as by the rivet 24 shown in FIG. 4, which rivet also serves for securing the halves of the handle together.

From FIG. 5, it can be seen that the gripping shell 16' is secured to the engagement and disengagement lever 16 by screws or rivets and due to the thinness and contour of the gripping shell 16', it is able to overlie the forward surface and the handle in a substantially flush manner so that it can be comfortably held with one hand and forms no potential hazard.

Figure 6:
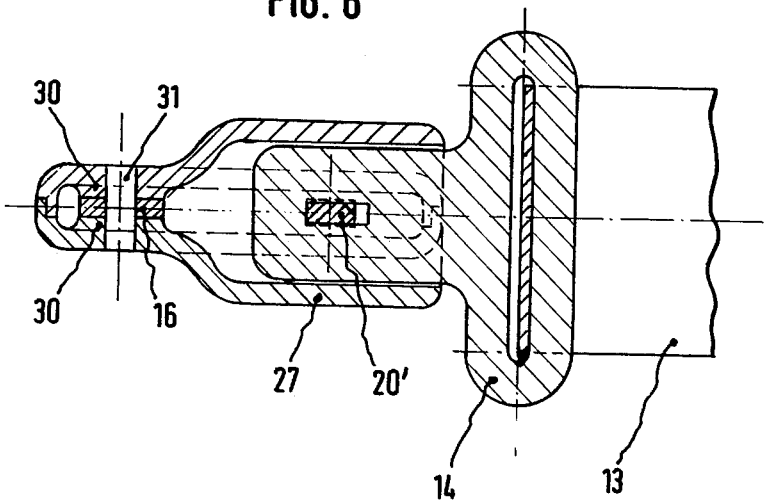
FIG. 6 is a section along line III—III in FIG. 2.

. FIG. 6 is a sectional view along the centerline X and more clearly illustrates the pivotal mounting of the engagement and disengagement lever 16 as well as the engagement of the finger 20 within the pull strap 14. More particularly, it can be seen that portions 30 of the upper and lower handle halves form bearings supporting the engagement and disengagement lever for sliding movement about the pivot pin 31 and for centering the lever 16 centrally within the handle so that the finger 20 will be properly aligned with a rectangular cutout 33 forming an engagement opening in the pull strap 14. As can be seen at 20', the finger 20 has a rectangular cross section that is receivable within the rectangular cutout of the pull strap.

Figure 7:
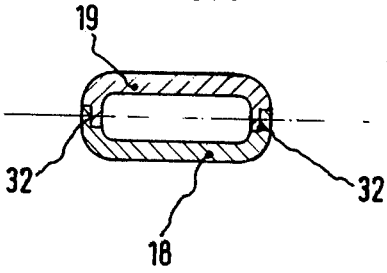
FIG. 7 is a section along line IV—IV in FIG. 2.

The hollow nature of the handle according to the present invention which enables it to be light in weight is shown in FIG. 7 with an exemplary means for interconnecting the shell halves 18 and 19 shown at 32.

The manner of use of the preferred embodiment will now be described. In preparation for skiing, a safety belt such as is shown in my co-pending application, referenced above, is fastened about the skier's waist and the connecting strap 13 (which is attached at one end thereto), adjusted to the proper length for the particular user. For connection of the handle to the pull strap 14, the lefthand portion of the handle 15 (as viewed in FIG. 1) is held in one hand by the skier while the pull strap 14 is manipulated into the opening 22 of the handle receptacle 27. While the finger 20 will be located in its engaged position within the opening 22 prior to insertion of the pull strap 14, due to the forwardly sloping surface 21' of the finger 20, the force applied by the skier for inserting the pull strap 14 will cause the end of the pull strap to engage against the surface 21' and force the finger 21 and lever 16 to rotate counterclockwise against the force of spring 17 until the finger is sufficiently clear of the opening 22 so as to permit insertion of the end of the pull strap. Once the rectangular cutout 33 is brought into alignment with the finger 21, the force of spring 17 will automatically produce a return pivoting of the lever 16, thereby causing the finger 21 to be shifted into its engagement position within the cutout 33. This particular aspect of the operation according to the present invention overcomes a problem that exists in accordance with my above-noted application wherein the engagement and disengagement lever is spring biased into its disengaged position as opposed to its engaged position, whereby the pull strap 14 could separate from the handle once the skier's hand is removed to grasp the disengagement lever. Once the pull strap 14 has been engaged by the finger 21, the skier's other hand is placed on the other handle portion so as to grasp the gripping shell 16 thereby firmly retaining the finger at its engagement position within the pull strap 14.

After the above-noted operations have been performed, skiing can then commence. Should the skier wish to disconnect the handle from the safety strap at some point during skiing, he need only remove his hand from the gripping shell and push forwardly with the other hand. By forcing the handle forwardly with respect to the skier's waist, the pull strap 14 will be caused to exert a rearwardly directed force against the forwardly facing inclined surface 21 of the finger 20 such that the finger 20 will be retracted against the force of spring 17 so as to enable removal of the pull strap 14 from the handle receptacle 27. Likewise, should the skier fall, removal of the skier's hand from the gripping shell 16' will enable the towing force to cause the same interaction between the finger surface 21 and the pull strap 14 noted to occur thereby causing disengagement of the pull strap from the handle so that the fallen skier will not be dragged by the handle.

While we have shown and describe only a single embodiment in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

What is claimed is:

1. Handle for a water ski towline comprising two shell-like halves defining a bar-type handle that is grippable by both hands of a skier so as to be holdable in a generally horizontal orientation during skiing, an engagement and disengagement means for detachably securing a pull strap secured to a connecting strap of a safety belt for water skiers to said handle, said engagement and disengagement means being located between areas of said handle that are grippable by respective hands of the skier and having an engagement finger that is engageable in a cutout of the pull strap, and spring means for biasing said finger toward a first engagement position within said cutout.

2. Handle for a water ski towline according to claim 1, characterized in that the engagement finger forms part of an engagement and disengagement lever provided for the engagement of the pull strap, said lever being accommodatable entirely within said two shell halves.

3. Handle for a water ski towline according to claim 2, characterized in that the handle is divided into two handle portions, one for each of a skier's hands, respectively, each of said handle portions extending, from a forwardly directed centerline of the handle, at a forwardly oriented inclination with respect to a towing direction for angling the water skier's wrists so as to prevent premature tiring.

4. Handle for a water ski towline according to claim 3, wherein said inclination forms an angle of approximately 8 to 12 degrees with respect to a line normal to said centerline.

5. Handle for a water ski towline according to claims 2 or 4, wherein said spring means is a compression spring, the engagement and disengagement lever is biased at one end by means of said compression spring and wherein a gripping shell is fixed to a second end of the handle, said gripping shell being contoured so as to cover a forward surface of the handle substantially flush therewith, whereby said finger is retainable in said engagement position by gripping of said gripping shell by one hand of the skier.

6. Handle for a water ski towline according to claim 5, wherein said engagement finger has a first surface facing toward a towing direction and inclined away from said towing direction and a second surface facing away from said towing direction and inclined toward said towing direction, whereby said engagement finger can be shifted out of said first position to a second disengaged position due to relative movement between said handle and pull strap in said towing direction.

7. Handle for a water ski towline comprising a bar-type handle that is grippable by both hands of a skier so as to be holdable in a generally horizontal orientation during skiing and an engagement and disengagement means that is actuatable by one hand for detachably securing a pull strap secured to a connecting strap of a safety belt for water skiers to said handle, said engagement and disengagement means being located between areas of said handle that are grippable by respective hands of the skier, wherein the bar-type handle is divided into two handle portions, one for each of a skier's hands, respectively, each of said handle portions extending, from a forwardly directed centerline of the handle, at a forwardly oriented inclination with respect to a towing direction for angling the water skier's wrists so as to prevent premature tiring.

8. Handle for a water ski towline according to claim 7, wherein said inclination forms an angle of approximately 8 to 12 degrees with respect to a line normal to said centerline.

* * * * *